US010465470B2

(12) United States Patent
Halbert et al.

(10) Patent No.: US 10,465,470 B2
(45) Date of Patent: Nov. 5, 2019

(54) RADIALLY EXPANDABLE RATCHETING BODY LOCK RING FOR PRODUCTION PACKER RELEASE

(71) Applicant: Baker Hughes, a GE company, LLC, Houston, TX (US)

(72) Inventors: Brandon M. Halbert, Houston, TX (US); Preston B. Lofgren, Haarlem (NL); Luis J. Ramos, Lafayette, LA (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 15/852,776

(22) Filed: Dec. 22, 2017

(65) Prior Publication Data

US 2018/0119511 A1 May 3, 2018

Related U.S. Application Data

(63) Continuation of application No. 14/566,232, filed on Dec. 10, 2014, now Pat. No. 10,030,468.

(51) Int. Cl.

| | |
|---|---|
| ***E21B 33/128*** | (2006.01) |
| ***E21B 33/129*** | (2006.01) |
| ***E21B 23/06*** | (2006.01) |

(52) U.S. Cl.

CPC ..... *E21B 33/129* (2013.01); *E21B 23/06* (2013.01); *E21B 33/128* (2013.01)

(58) Field of Classification Search

CPC combination set(s) only.
See application file for complete search history.

(56) References Cited

U.S. PATENT DOCUMENTS

| | | | | |
|---|---|---|---|---|
| 3,495,659 | A * | 2/1970 | McGill | E21B 23/006 166/125 |
| 3,603,388 | A | 9/1971 | Current et al. | |
| 4,161,984 | A | 7/1979 | Watkins | |
| 4,427,063 | A * | 1/1984 | Skinner | E21B 33/1292 166/134 |
| 5,029,354 | A * | 7/1991 | Boyd, Jr. | B26B 1/048 30/161 |
| 5,941,306 | A | 8/1999 | Quinn | |
| 6,629,563 | B2 | 10/2003 | Doane | |
| 7,080,693 | B2 | 7/2006 | Walker et al. | |
| 7,900,782 | B2 | 3/2011 | Hall | |
| 10,030,468 | B2 * | 7/2018 | Halbert | E21B 33/129 |

FOREIGN PATENT DOCUMENTS

| | | | | |
|---|---|---|---|---|
| GB | 1317629 | A * | 5/1973 | E21B 33/1291 |

* cited by examiner

*Primary Examiner* — Cathleen R Hutchins
*Assistant Examiner* — Ronald R Runyan
(74) *Attorney, Agent, or Firm* — Shawn Hunter

(57) ABSTRACT

A releasable production packer employs lock ring segments that are biased radially inwardly for engaging a mating pattern external to the packer mandrel. The mandrel has openings aligned with the segments and a release tool that latches to the mandrel for support and then moves the segments radially outwardly away from engagement with the mandrel so that the slips and sealing elements can extend axially and retract radially. After those movements the packer is retrieved. The release tools moves the locking segments only radially for the maximum mechanical advantage without risk of bending or deforming small parts.

9 Claims, 9 Drawing Sheets

RADIALLY EXPANDABLE RATCHETING BODY LOCK RING FOR PRODUCTION PACKER RELEASE

CROSS REFERENCE TO RELATED APPLICATION

This application is a continuation and claims priority to U.S. application Ser. No. 14/566,232 filed on Dec. 10, 2014, which is incorporated by reference herein in their entirety.

FIELD OF THE INVENTION

The field of the invention is release techniques and devices for production packers and more particularly where ratchet locking segments are radially displaced through mandrel wall openings.

BACKGROUND OF THE INVENTION

Packers are used in boreholes to isolate zones from each other. Typically these packers have a sealing system and slips that are radially extended on ramps referred to as slip cones for anchoring against the surrounding tubular. The setting of the packer can be accomplished hydraulically such as by dropping a ball on a seat and pressuring up the tubing which is communicated to a piston whose axial movement puts the packer in the set position. Another way such packers are set is with setting tools that are frequently run on wireline or slickline and the packer is set with relative movement of a setting tool. Typically the setting tool is releasably attached to the mandrel and has another component that bears on a setting sleeve to extend the slips and sealing assembly. When the set position is obtained, addition applied force from the setting tool shears a shear stud to allow the setting tool to release from the packer mandrel. The set position of such packers is usually retained by a ratcheting lock ring. The lock ring allows the setting movements initiated hydraulically or mechanically by the setting tool but the configuration of the ratchet assembly prevents a reversal of the setting movements thereby holding the set position.

In the past, if the packer is to be retrieved the ratcheting assembly was undermined by force that sheared a shear pin to allow the ratchet assembly to move to a release position so that the slips and sealing assembly could axially extend while radially retracting. Another way to release the packer without defeating the ratchet locking was to use a cutting tool and cut the packer mandrel clean through to allow the sealing assembly and slips to axially extend and radially retract for retrieval. As a last resort, the packer could be milled out with a milling tool driven by a downhole motor or a rotating string.

There have been designs that addressed the issue of packer release by forcing a disengagement of the ratchet profiles that allow relative movement in a first direction but prevent such movement in a reverse direction. In U.S. Pat. No. 7,080,693 the release occurs by penetrating through the mandrel wall with a penetration tool to access an annular chamber 80 for application of force to an axially moving release ring 66 that has spaced axially extending fingers 70 with leading ramps 72 as shown in FIG. 6. The axial movement under pressure in chamber 80 is designed to radially pry apart the ratchet patterns 56 and 58. This design uses a penetrator tool to release because in this packer application openings in the mandrel are considered not desirable because the packer mandrel is part of a pressure conducting tubular string. Apart from the inconvenience of running and locating the penetrating tool and then running pressure through the tool after penetration is the fact that fingers 70 move axially and are long and thin and subject to collapse if excessive force is required to separate the profiles on the mating locking rings.

Axial force is used to collapse a packer mandrel by radially pushing on a segment of the mandrel with a release tool that employs a collet running up a ramp to separate meshing profiles in the mandrel that are not ratcheting by moving a connecting segment radially. This design is shown in Doane U.S. Pat. No. 6,629,563. It releases in the same manner as packers that release with cutting the mandrel except that there is no destruction of parts with cutting tools.

Other designs employ axially movable sleeves to unlock mating parts of a lock assembly by converting the axial force into a radial force that overcomes a band spring biasing the locking segments toward the packer mandrel. This design is shown in U.S. Pat. No. 3,603,388. Here again designs that feature axial movement of thin sleeves or fingers can present problems if high forces are needed to dislodge the lock ring profiles apart and part failure could ensue.

What is needed and provided by the present invention is a release apparatus and method where the movement to separate the locking profiles is fully radial. In an application with a production packer that has a polished bore below to accept a production string there is no issue with mandrel openings that are above the sealing element of the packer. In such a packer the release tool operates through slots in the packer mandrel above the sealing element to radially displace locking ratchet segments that are radially biased inwardly. The release tool overcomes the bias to create a radial gap between the mandrel profile and the mating profile inside the segments so that the slips and sealing element of the packer can move axially and retract radially for recovery of the production packer. These and other aspects of the present invention will be more readily apparent to those of ordinary skill in the art from a review of the detailed description of the preferred embodiment and the associated drawings while understanding that the full scope of the invention is to be found in the appended claims.

SUMMARY OF THE INVENTION

A releasable production packer employs lock ring segments that are biased radially inwardly for engaging a mating pattern external to the packer mandrel. The mandrel has openings aligned with the segments and a release tool that latches to the mandrel for support and then moves the segments radially outwardly away from engagement with the mandrel so that the slips and sealing elements can extend axially and retract radially. After those movements the packer is retrieved. The release tools moves the locking segments only radially for the maximum mechanical advantage without risk of bending or deforming small parts.

DETAILED DESCRIPTION OF THE PREFERRED EMBODIMENT

Figure 1:
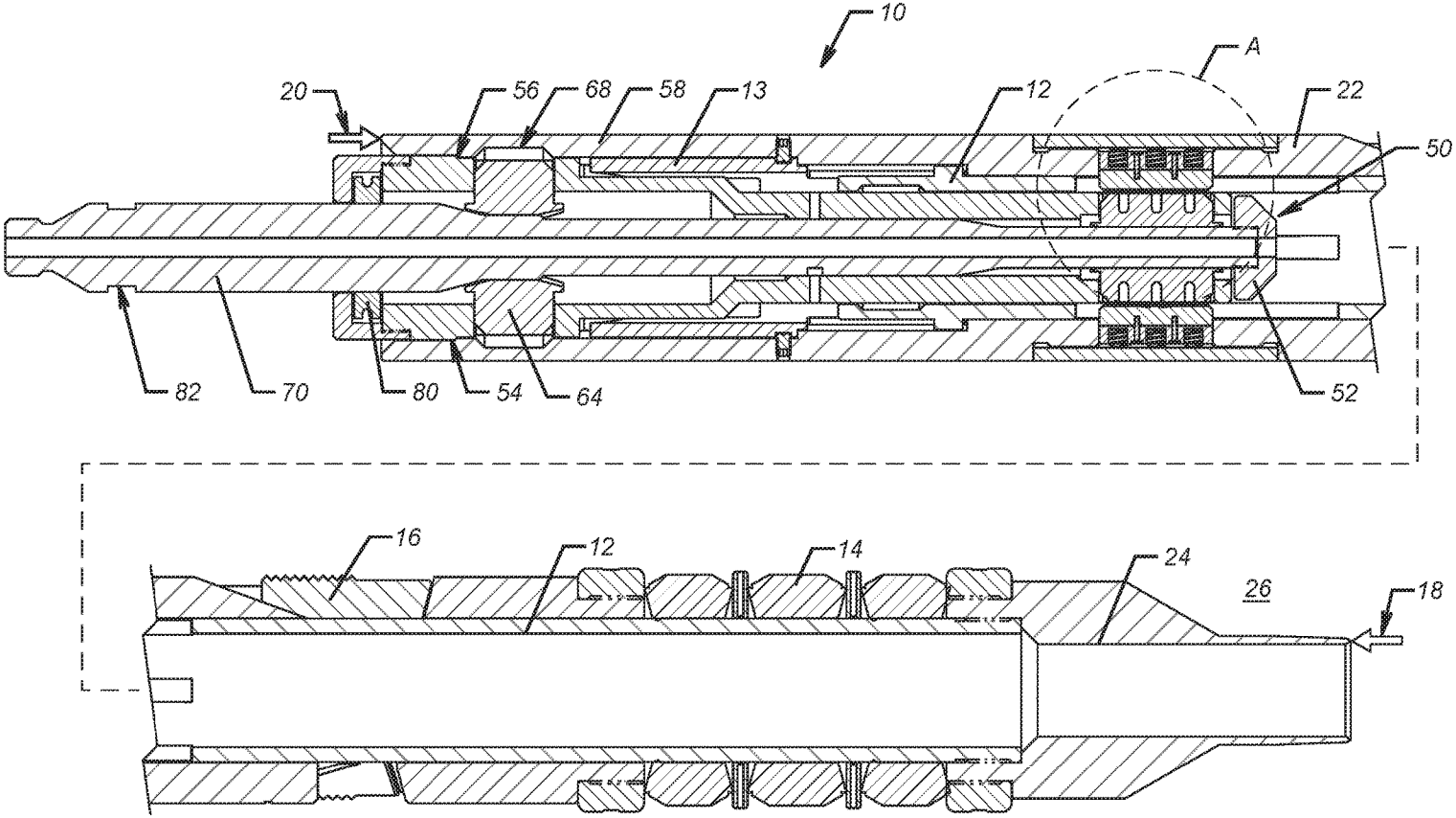
FIG. 1 is a section view of a production packer with the release tool inserted.
Figure 7:
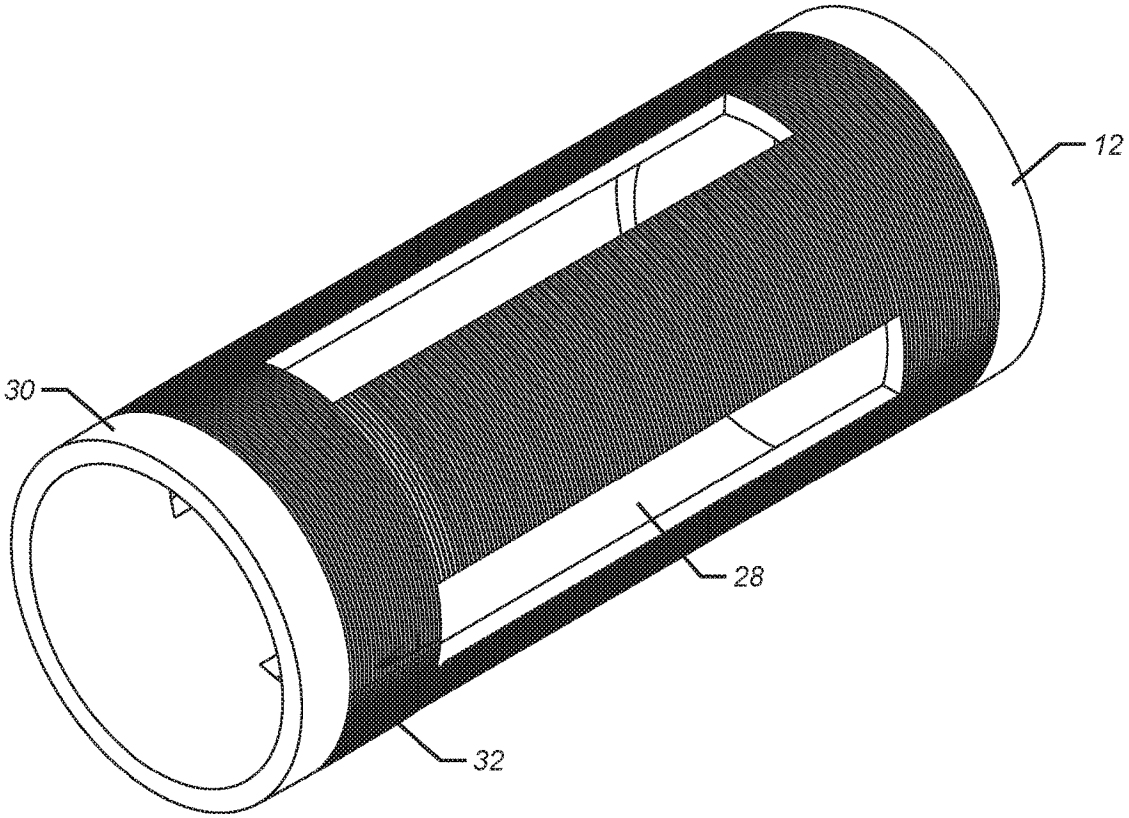
FIG. 7 is a perspective view of the mandrel part having slots and an external locking profile.
Figure 8:
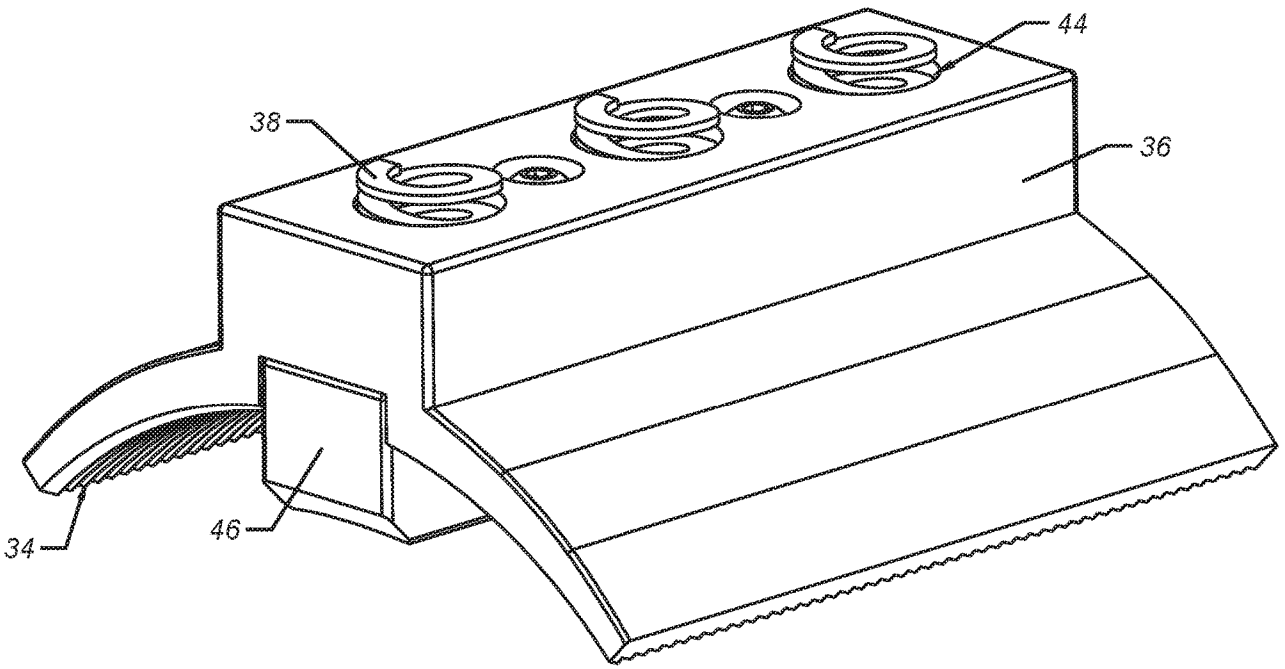
FIG. 8 is a perspective view of one of the locking segments that are mounted around the mandrel.

FIG. 1 shows a production packer 10 that has a mandrel 12 with a sealing assembly 14 made up of a plurality of seals and a slip assembly 16. To set the packer 10 a setting tool that is not shown that can be run on wireline or slickline that is also not shown an opposing force represented by arrows 18 and 20 is applied to move the slip cone 22 under the slip assembly 16 and compress the sealing assembly 14. Both extend radially into contact with a surrounding tubular to isolate a production zone from another zone in the well. Schematically illustrated at the lower end of the packer is a polished bore receptacle 24 into which production tubing that is not shown is extended with exterior seals to engage the polished bore 24. With the production tubing in place and the sealing assembly 14 extended, the production zone 26 below the sealing assembly 14 is effectively isolated. The upper part of the mandrel 12 can have openings 28 as best seen in FIG. 7 where a part of the mandrel 12 is illustrated in perspective. The exterior surface 30 has a ratchet pattern 32 that selectively engages the mating pattern 34 on segments 36 that are radially inwardly biased by springs 38 pushing off surface 40 of outer housing 42. FIG. 8 shows one of the segments in perspective. Springs 38 extend into respective bores 44 in each segment 36. A positioning lug 46 on each segment 36 extends into a respective opening 28 for alignment purposes. The openings 28 can be longer than the lugs 46 that extend into them but the openings 28 restrict rotational movement. Openings 49 in mandrel component 51 retain segments 36 against axial movement. In the preferred embodiment there are four segments 36 shown that extend over an arc of a bit under 90 degrees to facilitate assembly and manufacturing tolerances by leaving gaps 48 between adjacent ends of segments 36. When the packer 10 is set with relative axial movement as described above, pattern 34 ratchets over pattern 32 in a first direction. Reverse movement in an opposite direction to the first direction is prevented by the orientation of the ridges on the now mating patterns 32 and 34 with the springs 38 biasing the segments 36 radially inwardly to keep them in contact. The set of the packer 10 is now maintained against release.

Figure 2:
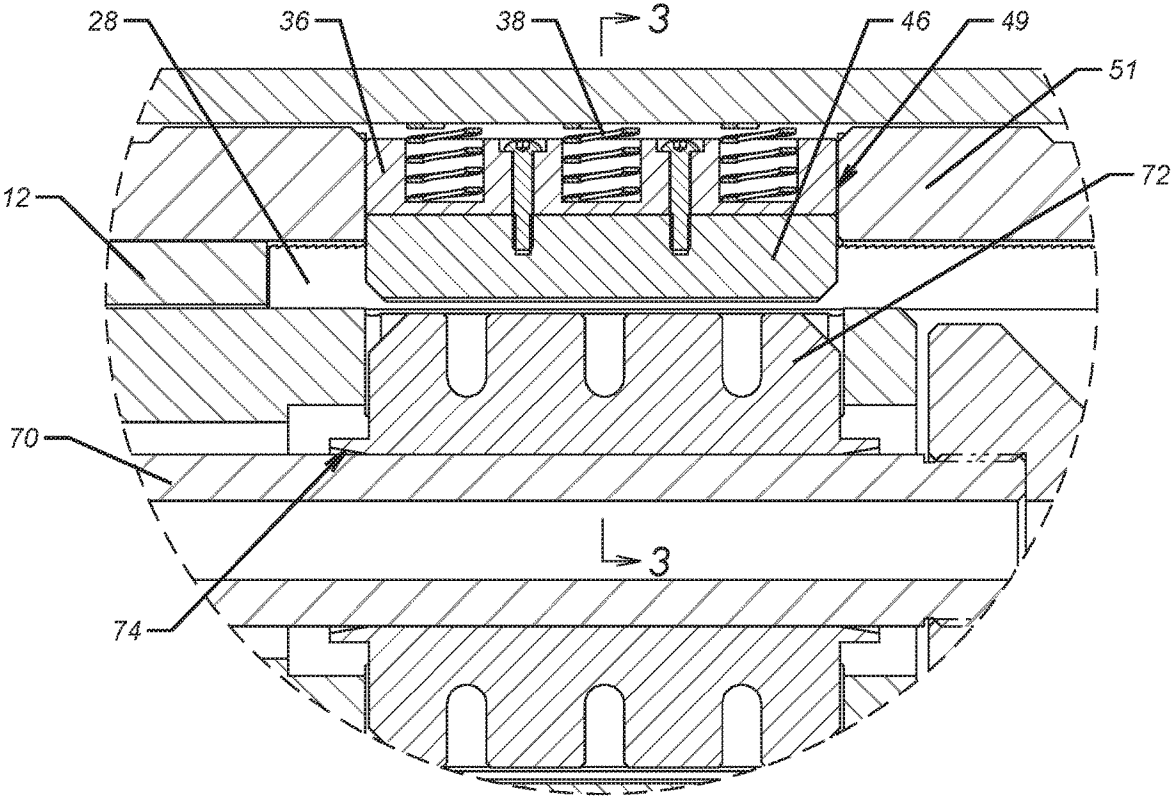
FIG. 2 is an enlarged view in the circle "A" of FIG. 1.
Figure 3:
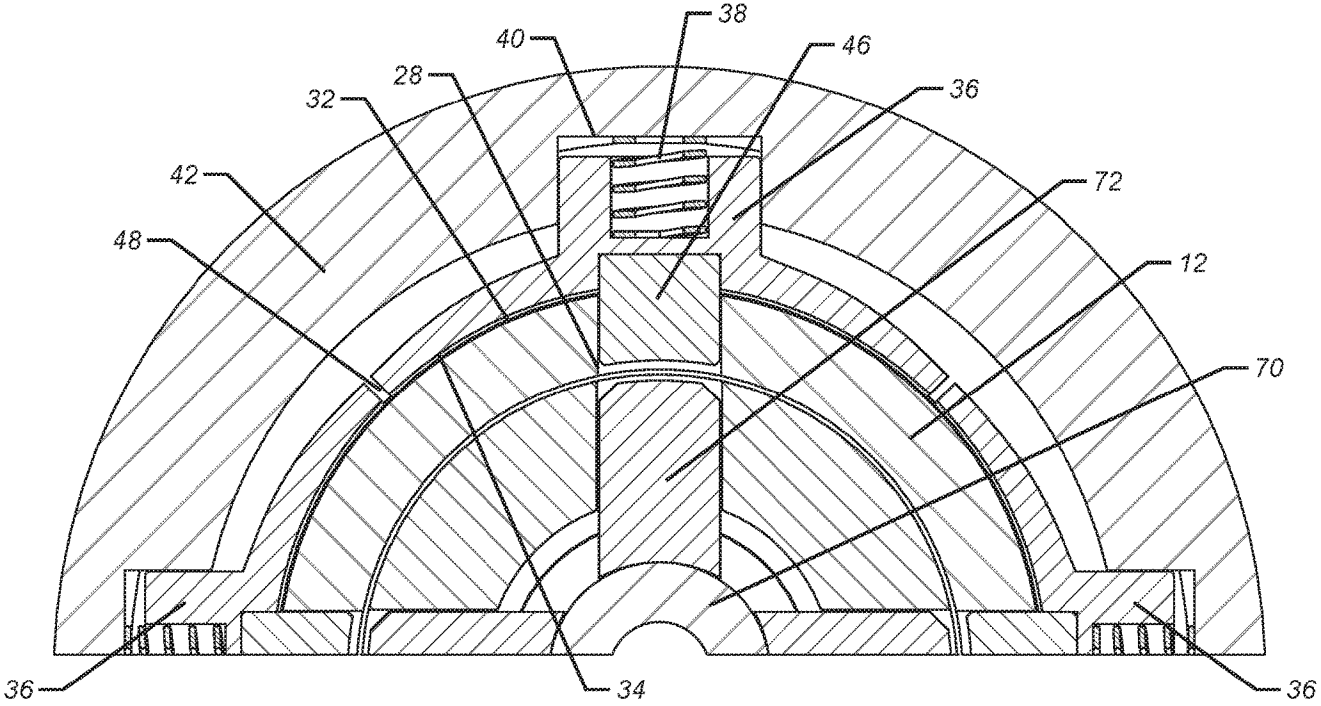
FIG. 3 is the view along section line 3-3 of FIG. 2.
Figure 4:
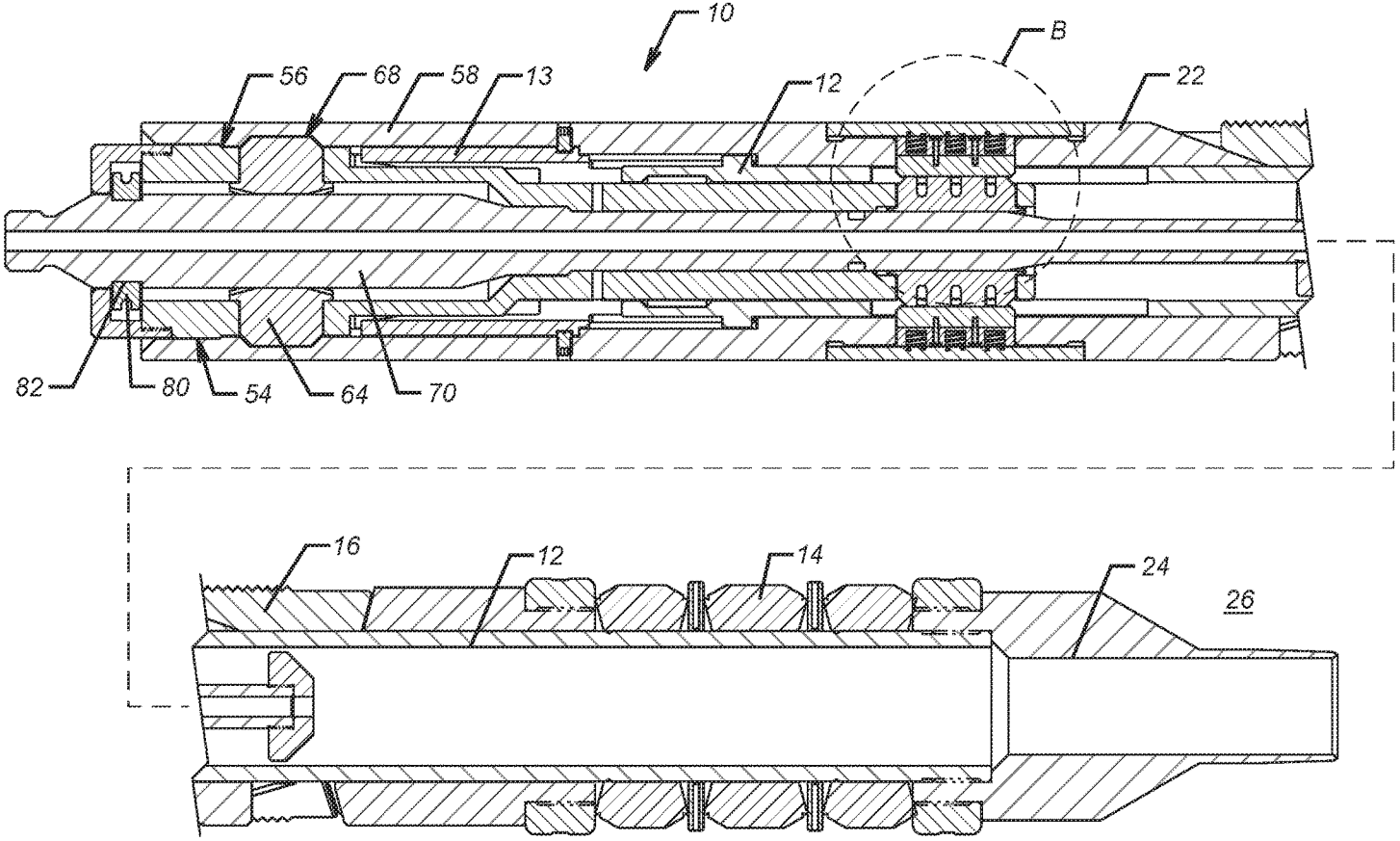
FIG. 4 is the view of FIG. 1 after radial extension of the dogs in the release tool to separate the profile on the lock segments from the opposing profiles on the mandrel.
Figure 5:
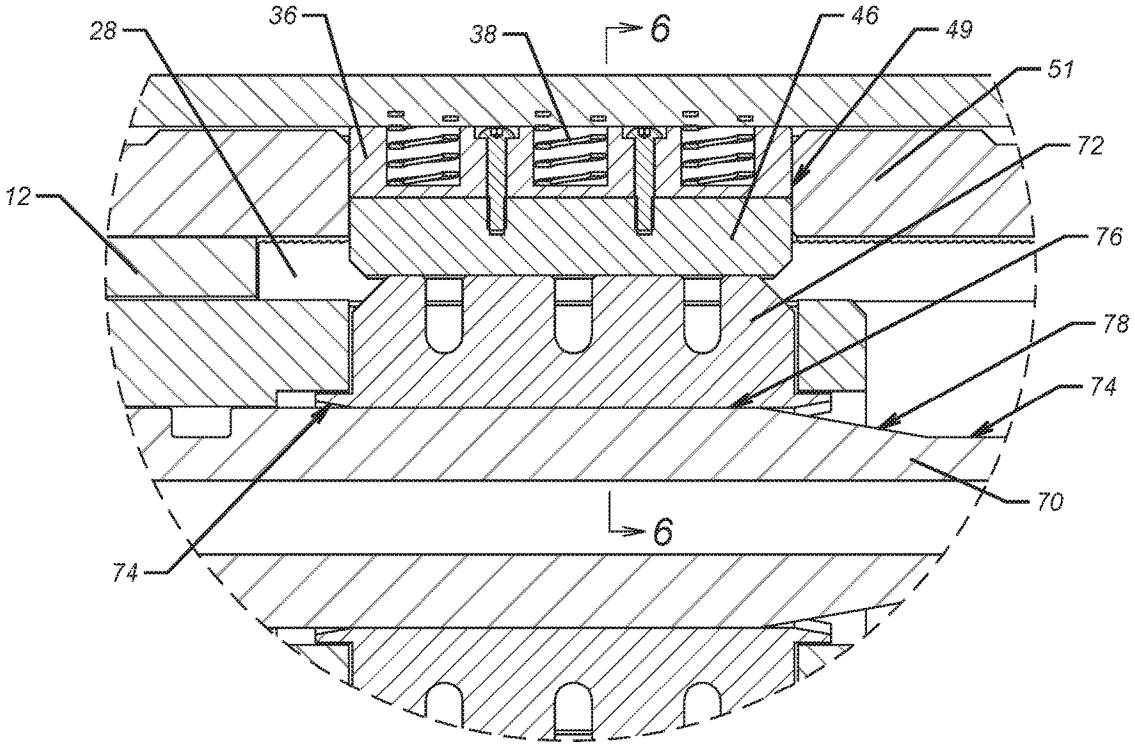
FIG. 5 is an enlarged view in the circle "B" of FIG. 4.
Figure 6:
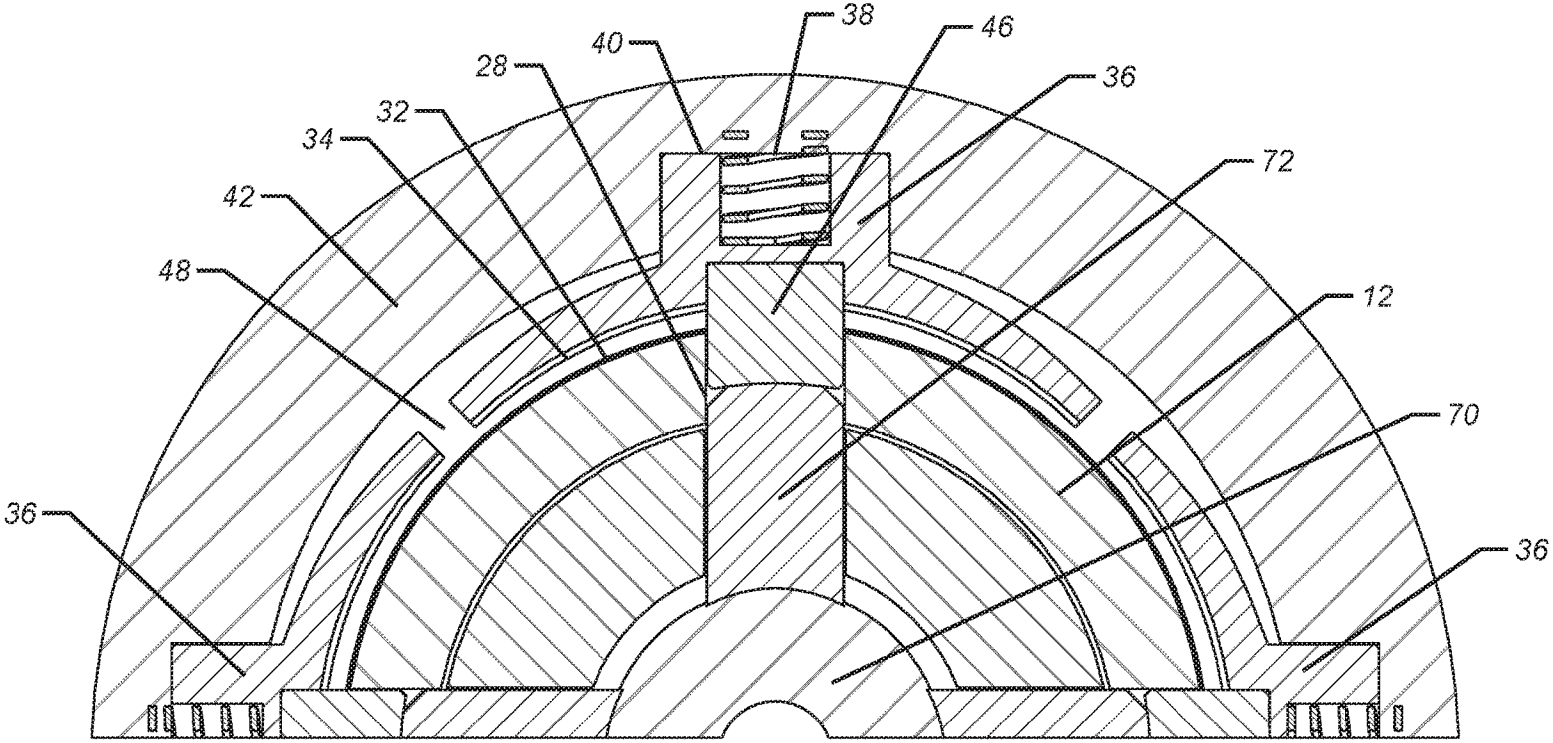
FIG. 6 is a section view along line 6-6 of FIG. 5.
Figure 9:
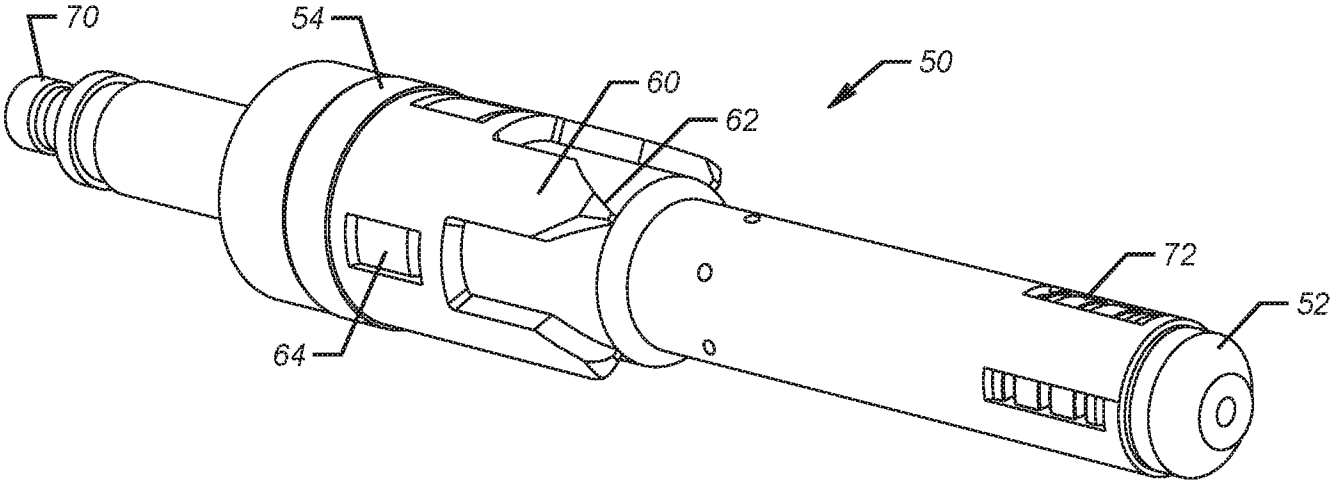
FIG. 9 is an perspective view of the release tool.

Release of the set packer 10 occurs with a release tool 50 best seen in FIG. 9 where the exterior of the tool is shown in perspective. The tool 50 has a leading end taper 52 to facilitate insertion into the mandrel 12. The tool 50 advances until a no-go shoulder 54 engages a mating surface 56 on outer housing 58. Spaced axial extensions 60 have tapered leading ends 62 for engagement of a similar pattern insert sleeve 13 in the outer housing 58 shown in FIG. 1 for the purpose of angular rotation if necessary to align the lugs 64 with recesses 68 to anchor the release tool 50 to the packer 10 when the lugs 64 are pushed out radially with axial movement of mandrel 70 of tool 50 when no-go 54 lands on the respective shoulder 56. Additional, the alignment of axial extensions 60 and insert sleeve 13 also align lugs 72 with slots 28 as best seen in FIG. 6. Lugs 72 are radially extended as mandrel 70 is forced to the right replacing surface 74 under lugs 72 with a larger diameter surface 76 that is located adjacent taper 78. This is best seen by comparing FIGS. 2 and 5. With lugs 72 pushed out radially as in FIG. 6 the mating ratcheting surfaces 32 and 34 are radially separated as shown in FIG. 6. Further movement of the mandrel 70 to the right will allow recessed profile 82 to engage with locking dogs 80 as shown in FIG. 4 to prevent releasing tool 50 from disengaging from packer 10. At this time an upward pull on mandrel 70 brings out the packer 10 because the lugs 64 are supported in respective recesses 68 and the slip and seal assemblies 16 and 14 respectively have extended axially and retracted radially.

Those skilled in the art will appreciate that what is described is a production packer with mandrel slots and ratchet locking segments that are radially biased toward the mandrel. One way relative movement is permitted to allow the packer to set and to hold the set position. The release involves a tool that registers with the packer for support and pushes dogs radially into the gripping segments to separate the meshing profiles by moving the segments against the force of the spring bias to allow the sealing and gripping assemblies to radially retract due to the ability to axially extend once the meshing surfaces separate. While 4 segments are illustrated differing amounts of segments can be used depending on the packer size. The meshing patterns can vary as long as they allow ratcheting relative movement in one direction and prevent relative movement in an opposite direction.

The above description is illustrative of the preferred embodiment and many modifications may be made by those skilled in the art without departing from the invention whose scope is to be determined from the literal and equivalent scope of the claims below:

We claim:

1. A locking assembly for a borehole tool comprising a relatively moving first mandrel and an outer assembly disposed around said first mandrel, comprising:

multiple spaced ratchet segments permitting relative movement between said first mandrel and said outer assembly in a first direction and preventing relative movement in a second direction opposite said first direction;

said ratchet segments are mounted between said first mandrel and said outer assembly;

said segments comprise at least one lug extending into a recess in said outer assembly to limit movement of said segments to radial movement in a direction perpendicular to an axis of said first mandrel; and said ratchet segments are biased toward said first mandrel, said bias comprising at least one coiled spring.

2. The assembly of claim 1, wherein:

said at least one coiled spring is located in a recess in said lug at one end and in contact with said assembly at an opposite end of said at least one coiled spring.

3. The assembly of claim 1, wherein:

said ratchet segments comprise a rounded surface with a first part of a ratchet combination.

4. The assembly of claim 3, wherein:

a second mandrel comprises a mating ratchet part to said first part.

5. The assembly of claim 3, wherein:

said rounded surface of each said ratchet segments comprises opposed ends spaced apart from an adjacent said segment.

6. The assembly of claim 5, wherein:

said rounded surfaces of said ratchet segments extend for substantially the circumference of a second mandrel.

7. The assembly of claim 1, wherein:

said ratchet segments comprise an alignment lug engaged to a second mandrel.

8. The assembly of claim 7, wherein:

said ratchet segments are moveable into a recess against a force from said at least one coiled spring under a force delivered through an opening in said second mandrel to defeat the ability of said ratchet segments to prevent relative movement in said second direction; and said alignment lug extending through said opening.

9. The assembly of claim 1, wherein:

said ratchet segments are movable into said recess against a force from said at least one coiled spring under a force delivered through an opening in a second mandrel to defeat the ability of said ratchet segments to prevent relative movement in said second direction.

* * * * *